US007946215B2

(12) United States Patent
Nemenoff et al.

(10) Patent No.: US 7,946,215 B2
(45) Date of Patent: May 24, 2011

(54) ACTUATOR CONTROLLER

(75) Inventors: Amir Nemenoff, Carcom (IL); Efraim Maayan, Galil Elion I (IL); Yoel Hadar, Kiryat Shmona (IL)

(73) Assignee: Habonim Industrial Valves & Actuators Ltd., D.N. Galil Elion (IL)

( * ) Notice: Subject to any disclaimer, the term of this patent is extended or adjusted under 35 U.S.C. 154(b) by 422 days.

(21) Appl. No.: 12/086,332

(22) PCT Filed: Oct. 30, 2006

(86) PCT No.: PCT/IL2006/001245

§ 371 (c)(1), (2), (4) Date: Jun. 11, 2008

(87) PCT Pub. No.: WO2007/069231

PCT Pub. Date: Jun. 21, 2007

(65) Prior Publication Data

US 2010/0224060 A1 Sep. 9, 2010

(30) Foreign Application Priority Data

Dec. 13, 2005 (IL) ..... 172540

(51) Int. Cl.
*F15B 13/042* (2006.01)

(52) U.S. Cl. ..... 91/446; 91/186

(58) Field of Classification Search ..... 91/437, 91/446, 186; 92/175
See application file for complete search history.

(56) References Cited

U.S. PATENT DOCUMENTS

| | | | | |
|---|---|---|---|---|
| 2,916,050 | A | 12/1959 | Ruhl | |
| 3,971,296 | A * | 7/1976 | Tugwell | 91/186 |
| 4,221,155 | A * | 9/1980 | Ongaro | 91/186 |
| 6,772,791 | B2 | 8/2004 | Neff | |

FOREIGN PATENT DOCUMENTS

| | | |
|---|---|---|
| EP | 1 363 054 A2 | 11/2003 |
| GB | 1 373 070 | 11/1974 |
| GB | 2 227 295 A | 7/1990 |

* cited by examiner

*Primary Examiner* — Michael Leslie
(74) *Attorney, Agent, or Firm* — Allan C. Entis, Intellectual Property Ltd.

(57) ABSTRACT

Actuator controller comprising a body (12) with an inlet port (14) coupled to a source of pressurized fluid and in flow communication with primary and secondary spool bores (16, 20); primary and secondary spools (60, 62); first and second cross flow ports (48, 52) communicating said primary and secondary spool bores, compression and expansion outlet ports (53, 54) for applying pressurized fluid to a return-biased actuator (110); and a venting outlet port (23); wherein return action of the working piston of the actuator is facilitated with aid of pressurized fluid already gained in the system.

19 Claims, 5 Drawing Sheets

ACTUATOR CONTROLLER

FIELD OF THE INVENTION

The present invention is generally in the field of controllers for controlling the operation of different actuators. More specifically the present invention is concerned with controllers suited for use in conjunction with return-biased actuators and in particular the invention provides intensification of the return force of the actuator.

BACKGROUND OF THE INVENTION

Controllers for operating and governing the operation of actuators which in turn are coupled to a varsity of valves and other devices are known. Such controllers typically comprise one or more ports connectable to a pressurized fluid source, which by sequential control signals close and open pressure ports and venting ports thereof to thereby impart motion to various valves and the like, articulated thereto.

A number of differing designs have been formulated for actuator controllers, such as those utilizing dual electromagnetic actuators to move a valve spool in opposite directions. Another example is the use of a double wound actuator, able to energize in both directions.

An alternative approach is the so called spring return pneumatic actuators which typically comprise one or more cylinders slidingly accommodating therein a spring-biased piston, wherein the piston is spring biased in one direction and pneumatically urged in the opposed direction. Such actuators are at times referred to as single action pneumatic actuators. Accordingly, when compressed air is applied at one end of the piston, the piston is thrust to load the biasing spring so as to provide a useful output bias thrust. However, upon discharging the compressed air the piston is retuned and the spring member is relaxed, with a useful but reversed output linearly reducing thrust, as the spring relaxes. This arrangement offers strong spring-biasing effect at the initial displacement of the piston, whereby the final thrust available as the piston comes to rest is considerably less than the initial return thrust.

An example of such as design is discussed in GB Patent No. 1373070 to Tugwell disclosing a pneumatic actuator comprising a double-acting piston separating two first chambers, spring means to urge the piston in one direction, and valve means adapted to admit compressed air to one of the chambers and thus to load the spring means, then to transfer some of such air into the other chamber at a selected phase position of the piston, and then to open the said one chamber to atmosphere whereby the combined forces of the spring means and of the compressed air acting on the piston in the other chamber, complete the power stroke of the actuator.

Hereinafter in the specification and claims, reference will be made to a pressurized fluid useful for operating the controller, with particular reference to pneumatic devices operated by pressurized air. The skilled person will appreciate that such apparatuses are operable with either pressurized air or liquid, the former often being more readily available and suitable for industrial environments.

SUMMARY OF THE INVENTION

It is an object of the present invention to provide a fluid-assist actuator controller, for cooperation in conjunction with an actuator of the spring-loaded type, wherein return action of one or more working pistons of the actuator is facilitated by said spring member and with aid of pressurized fluid already gained in the system.

According to the present invention there is provided an actuator controller comprising a body formed with a pressurized fluid inlet port for coupling to a source of pressurised fluid, and being in flow communication with a primary spool bore and a secondary spool bore extending axially within said body; a primary spool supported and axially displaceable within said primary spool bore; a secondary spool supported and axially displaceable within said secondary spool bore; a first cross-flow port and second cross flow port providing fluid communication between said primary spool bore and said secondary spool bore, at least one compression outlet port and at least one expansion outlet port both extending from said primary spool bore, and a venting outlet port.

According to a particular design of the present invention, the primary spool bore is formed with a first chamber and an second chamber partitioned from one another by a neck portion sealable by a first seal fixed over the primary spool; said primary spool further comprises a first one-way seal membrane extending in the first chamber and a second one-way seal membrane extending in the second chamber, and admitting fluid flow only in direction from the first chamber towards the second chamber; and a second seal fitted at an end of the primary spool to selectively seal the venting outlet port.

Furthermore, the secondary spool comprises a small spool head being in flow communication with the pressurized fluid inlet and comprising a small seal; and a large spool head being in flow communication with the expansion outlet port and comprising a large seal.

The arrangement according to the present invention is such that the secondary spool is displaceable between a first position in which the small seal seals fluid flow between the pressurized fluid inlet and the first cross-flow port, and a second position admitting fluid flow between. Furthermore, the secondary spool comprises a secondary first chamber being in fluid communication with the pressurized fluid inlet and partitioned from an intermediate chamber by the small seal; said intermediate chamber being in flow communication with the first cross-flow port; and a major chamber partitioned from the intermediate chamber by the large seal and being in flow communication with the second cross flow port.

According to a particular design of the invention the large spool area has a large surface area extending in the major chamber, and a small surface area extending in said intermediate chamber.

According to a particular arrangement of the invention the second one-way seal membrane is axially displaceable about the primary spool.

By some further embodiments, the controller may comprise one or more of the following arrangements:

- a manual override for axially displacing the primary spool within the primary spool bore so as to open the venting outlet port. Said manual override may be formed at a sealing plug coaxial with the primary spool bore;
- an adjusting member for adjusting axial positioning of the primary spool so as to govern seal engagement of the first seal of the primary spool within the neck portion of the primary spool bore. The adjusting member is screw fitted at a sealing plug coaxial with the primary spool bore.
- The at least one compression outlet port and at least one expansion outlet port are fitted with a Namur-type coupling arrangement.
- The venting outlet port may be fitted with an adjustable valve for controlling venting rate of the second chamber.

The controller according to the invention may be applied to a variety of mechanisms such as, emergency braking systems, door systems, etc. utilizing a pneumatic lock/return system.

By a further particular design of the controller the first cross-flow port and second cross flow port extend coaxially with the compression outlet port and at least one expansion outlet port, respectively.

According to the invention, the primary spool is displaceable between a first extreme position where a fore spool head bears against a sealing plug of the primary spool bore, and a second extreme position wherein a shoulder of the primary spool extending intermediate the first seal and the first one-way valve seal bears against a shoulder of the neck portion of the primary spool bore.

the design of the controller is such that the pressurized fluid inlet port entails full displacement of the primary spool and the secondary spool, into a first position respectively, wherein the primary spool is displaced so as to admit pressurized fluid flow to the compression outlet port and the first chamber and an second chamber are sealingly disengaged from one another; and the secondary spool is displaced so as to seal fluid flow between the pressurized fluid inlet and the first cross-flow port.

Furthermore, the arrangement is such that terminating pressure through the pressurized fluid inlet port entails displacement of the primary spool so as to seal the venting outlet port and resume fluid flow between the first chamber and an second chamber; and further, the secondary spool displaces so as to resume fluid flow in direction from the first cross-flow port towards the pressurized fluid inlet, until the pressure camber and the second chamber are at pressure equilibrium.

And further wherein the venting outlet port opens only to exhaust fluid from the second chamber and is otherwise sealed by is a sealing ring mounted on the primary spool, to thereby prevent external fluid from entering the controller through the venting outlet port.

According to a further aspect of the present invention, there is provided an actuator system comprising an actuator and an actuator controller as described hereinabove, said actuator being formed with one or more pistons displaceable within a piston cylinder, each cylinder being sealingly divided into a first chamber being in flow communication with an compression outlet port of the said actuator controller, and an second chamber being in flow communication with an compression outlet port of said actuator controller; said piston being biased in direction to expand said second chamber.

BRIEF DESCRIPTION OF THE DRAWINGS

In order to understand the invention and to see how it may be carried out in practice, several embodiments will now be described, by way of non-limiting examples only, with reference to the accompanying drawings, in which.

DETAILED DESCRIPTION OF EXEMPLARY EMBODIMENTS

Figure 1:
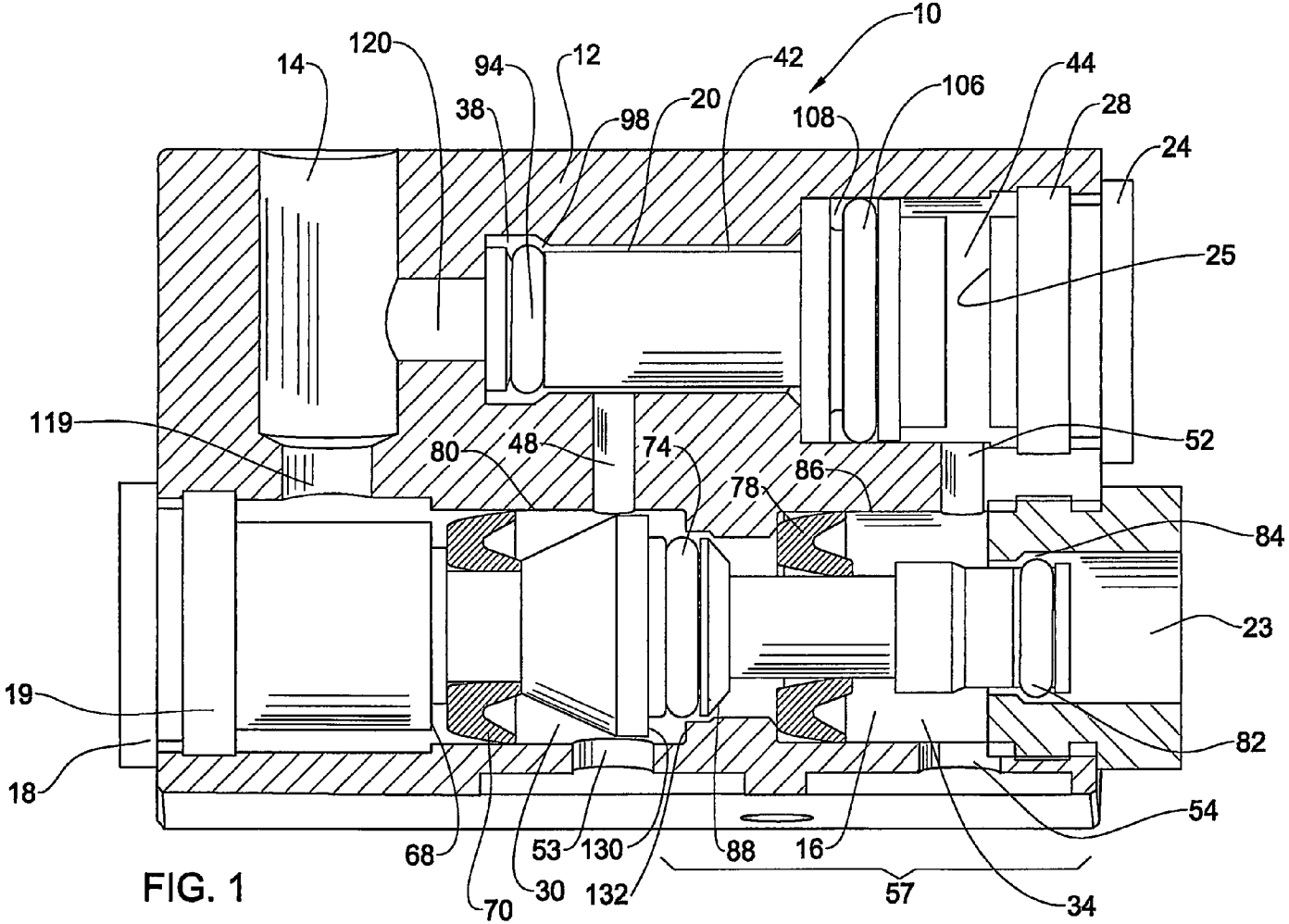
FIG. 1 is a three-dimensional sectioned illustration of an actuator controller in accordance with the present invention.
Figure 2:
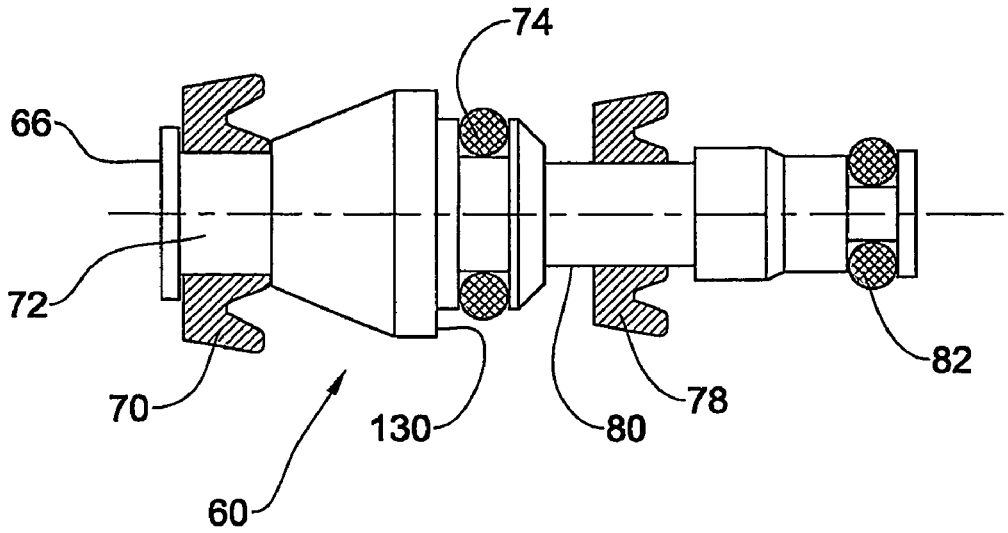
FIG. 2 is an elevation of the primary spool used in the controller in accordance with the illustrated embodiment.

Attention is first being directed to FIGS. 1 to 4 for understanding the general construction of the actuator controller in accordance with the present invention generally designated 10. The controller comprises a body 12 fitted with a pressurized flowing inlet bore 14 adapted for coupling to a source of pressurized fluid, e.g. by a threaded coupling, or otherwise, as known per se.

Transversely extending within the body 12 there is a primary spool bore 16 sealed at one end by a sealing plug 18 screw coupled at 19 to the body 12.

Extending from the pressurized fluid inlet port 14 and in parallel to the primary spool bore 16, there is a secondary spool bore 20 sealed by a plug 24 screw threaded to the body at 28.

The primary spool bore 16 is divided into a first chamber 30 and a second chamber 34 and the secondary spool bore 20 is divided into a secondary first chamber 38 being in flow communication with conduit 120 and the pressurized fluid inlet port 14, and further there is an intermediate chamber 42 and a major chamber 44.

A first cross-flow port 48 extends between the first chamber 30 of the primary spool bore 16 and the intermediate chamber 42 of the secondary spool bore 20, and a second cross-flow port 52 extends between the second chamber 34 of the primary spool bore 16 and the major chamber 44 of the secondary spool bore 20, providing controlled fluid flow between said chambers, as will become apparent hereinafter.

Extending from the first chamber 30 of the primary spool there is a compression outlet port 53 and an expansion outlet port 54 extends from the second chamber 34.

Whilst in the present embodiment, and as illustrated in the annexed drawings, there is provided only a single compression outlet port and a single expansion outlet port, it is to be appreciated that there may be more such ports, depending on the desired application. Furthermore, in the particular embodiment, the body 12 is fitted with a Namur-type coupler 57 (i.e. Namur-type interface), configured and sized in accordance with that standard.

Figure 3:
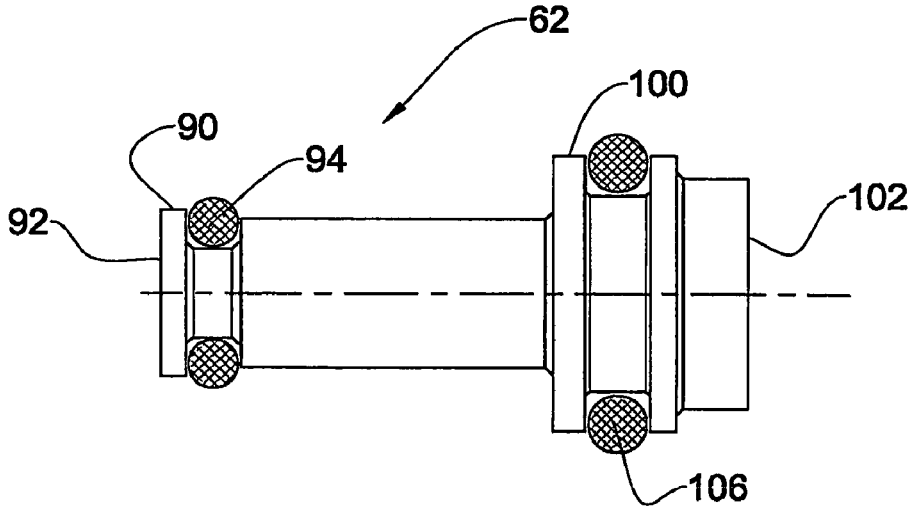
FIG. 3 is an elevation of the secondary spool used in the illustrated embodiment.

With further reference being made to FIGS. 3 and 4, it is noticeable that the primary spool bore 16 accommodates an axially displaceable primary spool 60 and the secondary spool bore 20 accommodates an axially displaceable secondary spool generally designated 62. The primary spool 60 comprises a substantially flat fore-end 66 fitted for stopping against a substantially flat end 68 of plug 18 (FIG. 1) and further the primary spool 60 comprises a first one-way seal membrane 70 made of resilient material and fixedly retained in position within a groove 72 sized accordingly. A first seal 74, in the form of an O-ring is fixedly positioned on the primary spool 60 which further comprises a second one-way seal 78 slidingly displaceable over a intermediate portion 80 of the primary spool 60. Spool 60 is further fitted at its other end with a second seal 82 in the form of an O-ring, fitted for selective sealing of shoulder 84 formed at the venting outlet port 23.

Turning back now to FIG. 1, it is noticed that the first one-way seal membrane 70 slidingly bears against the substantially smooth wall portion 80 of intermediate portion of the primary spool bore 16 in a sealing engaging manner, allowing fluid to flow only in one direction namely from left to right as visualized in the figure. Similarly, the second one-way seal membrane 78 slidingly bears against a corresponding second substantially flat portion 86 of the primary spool bore 16 to thereby provide sealing engagement therebetween and allow fluid flow over the one-way seal membrane in the same direction, namely from left to right as visualized in FIG. 1 and as will be explained hereinafter and exemplified with reference to FIGS. 4A to 4D.

The first O-ring seal 74 is fitted for sealing fluid flow between the first chamber 30 and the second chamber 34 at an abutting sealing portion 88 of the primary spool bore 16.

FIG. 3 illustrates the secondary spool 62 comprises a small spool head 90 formed with a substantially flat forehead 92 and being in flow communication with the pressurized fluid inlet 14 (FIG. 1) and comprising a small O-ring seal 94 fitted for sealing against a corresponding neck portion 98 in the secondary spool bore 20, partitioning the secondary first chamber 38 from the intermediate chamber 42. At an opposite end of the secondary spool 62 there is a large spool head 100 formed with a flat head 102 and comprising a large O-ring seal 106 fitted for sealing abutting against smooth wall 108 (FIG. 1) of the secondary spool bore 20 thereby forming a sealed partition between the intermediate chamber 42 and the major chamber 44.

Further attention is now directed to FIGS. 4A-4D illustrating how the actuator controller 10 in accordance with the present invention cooperates in conjunction with an actuator, in accordance with one particular embodiment designated 110. Whilst in the particular embodiment the actuator 110 is a double piston actuator, of the so-called spring return type, it is to be appreciated that the controller in accordance with the present invention may be used with a variety of different actuator types such as rack and pinion, skotch yoke, diaphragm and vane types, spring return pistons, etc. as known in the art.

In the particular example of FIGS. 4A-4D a pressure compartment 112 of the actuator 110 is coupled to the compression outlet port 53 of the controller, and two outlet ports 113, each extending from a spring compartment 114, are flow coupled to one another by a pressure line 116 which in turn is coupled to the expansion outlet port 54 of the controller 10.

Hereinafter in the particular example, particular reference is made to a pneumatic system wherein the working fluid is compressed air. However, it is to be appreciated by a person skilled in the art that the working fluid may be any gas or liquid.

At an initial state (FIG. 4A) pressurized air is introduced into the pressurized fluid inlet port 14 expanding through conduit 119 into the primary spool bore 16, deforms the first one-way seal membrane 70 resulting in axial displacement of the primary spool 60 until a shoulder 130 of the primary spool 60 (see FIG. 2) comes to rest against a corresponding shoulder 132 formed in the primary spool bore 16.

Figure 4A:
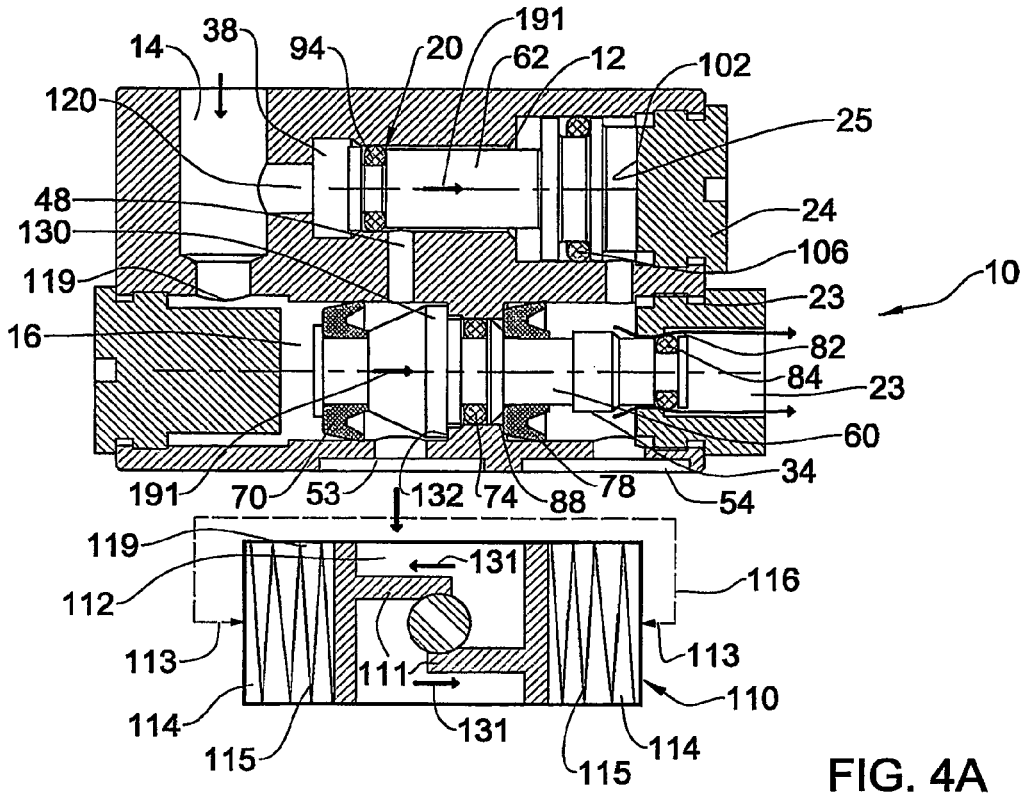
FIGS. 4A-4C illustrate consecutive steps of a sequence of operation of the controller in accordance with the present invention cooperating in conjunction with an actuator.

During axial displacement of the primary spool 60 into the position seen in FIG. 4A, air initially captured within the second chamber 34 and at the major chamber 44 and the cross-flow port 52, may now be discharged to the atmosphere through venting outlet port 23 since the second O-ring seal 82 disengages from the respective shoulder 84, to allow a venting aperture therebetween. Pressurized air now flows through the first cross-flow port 48 into the intermediate chamber 42 of the secondary spool bore 20 resulting in pressure applied against the large spool head 100 resulting in further and complete displacement thereof against the stopper plug 24.

Upon displacement of the primary spool 60 to the position seen in FIG. 4A, the first O-ring seal 74 adequately seals against surface 88 of the primary spool bore 16, thus providing pressure seal between the first chamber 30 and the second chamber 34 of the primary spool bore 16, resulting in pressure built-up in the first chamber 30 and within pressure compartment 112 respectively.

During displacement of the primary spool 60, pressurized fluid (air in the discussed example) from the fluid inlet port 14 expands also through conduit 120 into the secondary first chamber 38 of the secondary spool bore 20, resulting in axial displacement of the secondary spool 62 in the direction of arrow 124, until its head surface 102 comes to rest against face 25 of seal plug 24. At this situation the small seal 94 of the secondary spool 62 seals fluid flow between the pressurized fluid inlet 14 and the intermediate chamber 42 of the secondary spool bore 20, also sealing fluid flow between duct 120 and first cross-flow port 48. Displacement of the secondary spool 62 to the position of FIG. 4A entails exhaustion of residual air from major chamber 44 through the second cross-flow port 52 and out through the open venting outlet port 23

Air pressure build up in the actuator pressure chamber 112 of the actuator 110, results in axial displacement of the double-rack pistons 111 in opposite directions as illustrated by corresponding arrows 131, against the biasing affect of compression springs 115 in spring chambers 114. Now the system is in a so-called steady state and standby position.

It is appreciated that in the standby position, in the event of pressure fluctuations of the pressurized fluid, the pressurized air trapped in the first chamber 30 retains the actuator at its recent position as all outlets from the first chamber 30 are now sealed, namely by the first one-way seal membrane 70, the small O-ring seal 94 and the large O-ring seal 106 (of the secondary spool 62) and by the first seal 74, respectively. Similarly, any pressure surge will remain trapped within in the actuator such that upon pressure cease, the trapped compressed air is readily available, offering the highest available value of stored energy.

Upon ceasing the pressurized fluid through the pressurized fluid inlet port 14 (FIG. 4B), pressure at the pressure chamber 112 of the actuator 110 and within the first chamber 30 now acts against the non return membrane 70 which results in displacement of the primary spool 60, in direction of arrow 140 until the fore surface 66 comes to rest against surface 68 of plug 18. At this state, the first O-ring seal 74 disengages from shoulder 88 and fluid flow is facilitated, from the first chamber 30 towards the second chamber 34, whilst seal 82 engages with shoulder 84 so as to seal the venting outlet port 23. Pressurized air from pressure chamber 112 of the actuator 110 now flows into the first chamber 30 and via the gaps formed between the first O-ring seal 74 and the corresponding sealing edge 88 of the primary spool bore 16 thus deforms the second one-way seal membrane 78 such that the compressed air now flows through the second chamber 34, along arrows 37 (FIG. 4B) and via the compression outlet port 54 to the coupling duct 116 and into the spring chambers 114.

The compressed air now flowing into pressure line 116 generates pressure in piston chambers 114 which together with the biasing effect of return springs 115 results in force applied on the pistons 111 to contract and thus rotate the pinion 121.

Figure 4B:
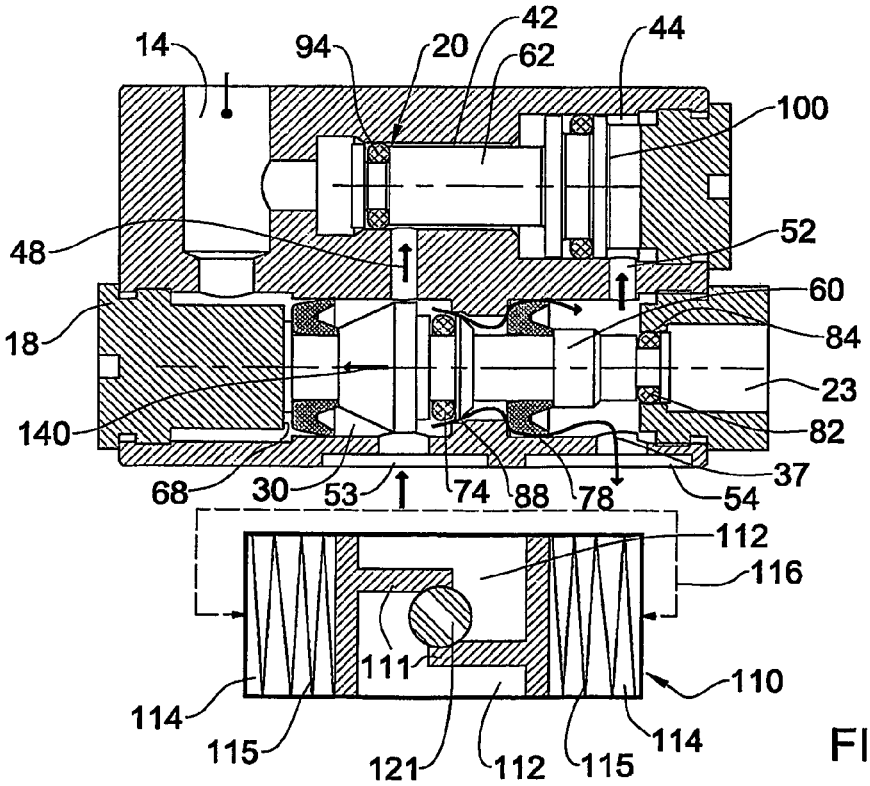
Figure 4C:
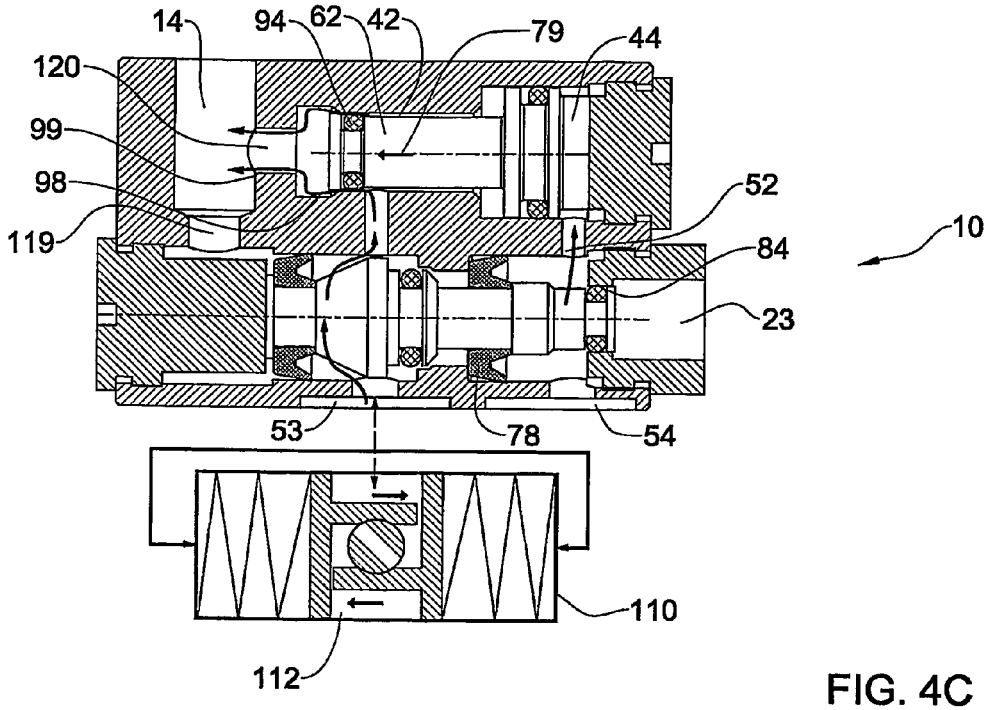

Further, pressurized air now flows also through the second cross-flow port 52 resulting in pressure build-up within the major chamber 44 whereby the secondary spool 62 now begins displacement leftwards (arrow 79 in FIG. 4C). This occurs as a result of pressure equilibrium between the first chamber 30 and the second chamber 34 and the associated intermediate chamber 42 and major chamber 44, respectively. This situation is reached as a result of difference in surface area applied on opposite faces of the large spool head 100 namely at the major chamber 44 and the intermediate chamber 42 and the surface area of the small seal 94.

Upon displacement of secondary spool 62 leftwards, i.e. into the position of FIG. 4C, seal 94 disengages from neck portion 98 to allow fluid flow therethrough, and through conduit 120 into pressurized fluid inlet 14, thus venting the pressure compartment 112 of the actuator 110, the first chamber 30 (via first cross-flow port 48) and the intermediate chamber 42, along arrow 99. At this situation, residual pressure remains trapped at second chamber 34 and the pressure line 116, spring cambers 114, second cross-flow port 52 and the major chamber 44, respectively.

The residual pressure within the system provides additional thrust on the pistons 111 of the actuator 110, in addition to the biasing effect of the springs 115.

The next sequence of operation is similar to the situation disclosed at the initial situation of FIG. 4A.

It is noticed from the above disclosure that the above system utilizes compressed air already contained within the actuator and which has been used for activating the pistons in one direction, for operating it in an opposite direction, instead of merely discharging said utilized pressurized air to the atmosphere.

The controller acts as a built-in automatic sensor for torque increase that will utilize the added energy from residual air in the first chamber to give additional torque for operating the actuator when required. Any delay in the actuator movement that is a result of increasing torque (i.e. resistance applied by a valve or other device articulated thereto), will cause the air pressure to equalize between the first chamber and the second chamber sooner and provide the additional torque required for overcoming said resistance.

The sealed position of venting outlet port 23 prevents ingress or suction of ambient air and particles into the controller 10 and/or actuator 110 whereby such ambient, untreated air (not to mention dirty air) may cause corrosion and damage the system.

Another advantage of the a actuator controller in accordance with the present invention is, as mentioned hereinabove, that at the event of non continuous pressure supply (sudden or scattering irregulate pressurized air supply) the actuator retains the highest pressure because of the non return seal valve membranes, and maintains its position so as to retain its last acquired position with maximal stored compressed fluid.

It is further noticeable that the second one-way seal 78 is displaceable over the primary spool 60 between its first position noticeable in FIGS. 4A and 4D and the second position noticeable in FIGS. 4B and 4C. This enables further displacement of the primary spool 60 with respect to the second one-way seal membrane 78, in case of residual air pressure within the second chamber 34 and upon applying pressure through the pressurized fluid inlet 14.

Figure 5:
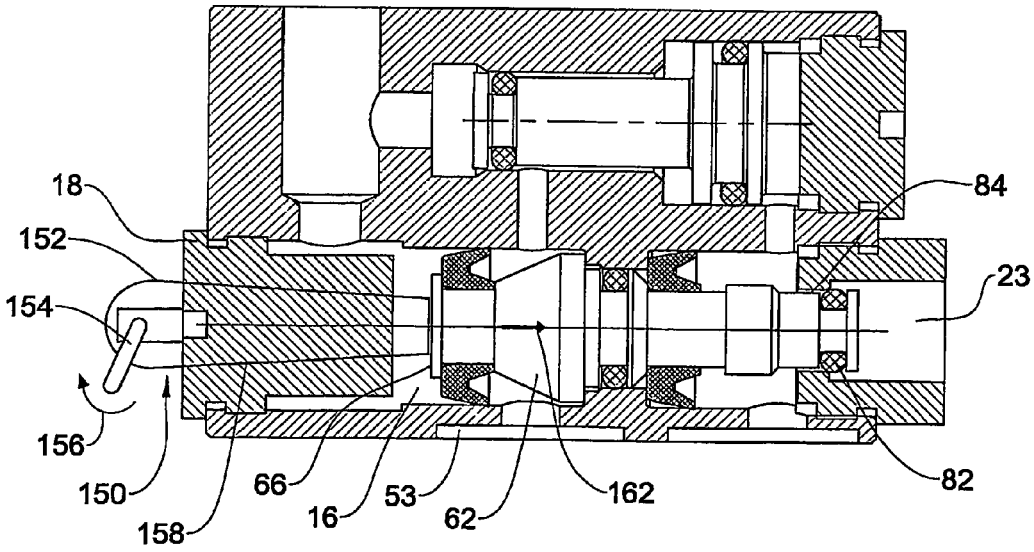
FIG. 5 is a modification of a controller in accordance with the present invention fitted with a manual override.

FIG. 5 illustrates a modification of the invention wherein a manual override system generally designated 150 is provided for axially displacing the primary spool 60 within the primary spool bore 16 so as to open the venting outlet port 23, thus discharging compressed air within the spring chambers 114 of the actuator (not shown in FIG. 5).

The manual override system 150 comprises an eccentric wheel 152 fixed to plug 18 and fitted with a manual lever 154 whereby rotating the lever in the direction of arrow 156 entails axial displacement of a pushing rod 158 bearing against fore surface 66 of the primary spool 60 displacing it in the direction of arrow 162, whereby the second O-ring seal 82 disengages from the sealing shoulder 84, thus opening the venting outlet port 23.

Figure 6:
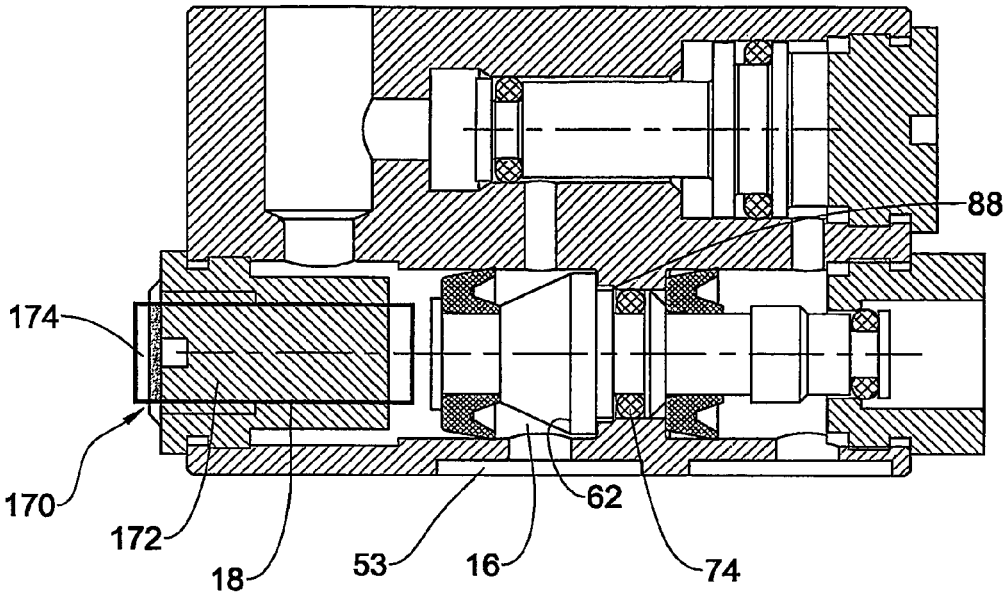
FIG. 6 is a modification of the invention illustrating a controller fitted with a primary spool adjusting member.

FIG. 6 illustrates still a modification of the invention wherein the plug 18 sealing the primary spool bore 16 is fitted with an adjusting member generally designated 170 comprising a screw threaded boss 172 which may gently be axially displaced with respect to plug 18 by means of an adjusting screw 174. Such adjustment provides manual readjusting the axial positioning of the primary spool 60 within the primary spool bore 16, so as to govern the sealing engagement of the first O-ring seal 74 with respect to the sealing shoulder 88 of the primary spool bore 16 so as to delay or advance displacement of the primary spool 60 by changing the point of sealing contact namely, changing the time at which pressure equilibrium between the first chamber 30 and the second chamber 34 is obtained.

Figure 7:
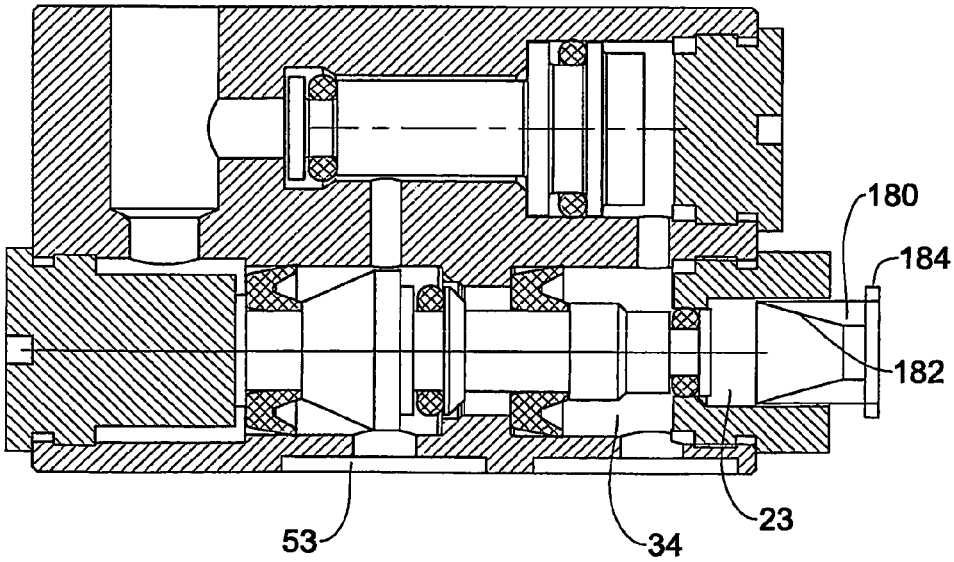
FIG. 7 is a further embodiment of a controller in accordance with the present invention wherein the venting outlet port is fitted with an adjustable vent valve.

In the embodiment of FIG. 7 the venting outlet port 23 is fitted with an adjustable nozzle 180 for controlling the venting rate of the second chamber 34 so as to control the actuator operating speed within the system at which the controller is applied. The adjusting nozzle 180 in accordance with the example of FIG. 7 is screw coupled to the venting outlet port 23 and comprises a tapering outlet nozzle 182, the outlet section of which is controllable by a screw coupled nozzle end 184, rotation of which adjusts the size of the outlet orifice.

It is to be appreciated that a controller in accordance with the present invention may be integrated within a housing of a solenoid pressure supply line.

Whilst some embodiments have been described and illustrated with reference to some drawings, the artisan will appreciate that many variations are possible which do not depart from the general scope of the invention, mutatis, mutandis.

The invention claimed is:

1. An actuator controller comprising a body formed with a pressurized fluid inlet port for coupling to a source of pressurised fluid and being in flow communication with a primary spool bore and a secondary spool bore extending axially within said body; a primary spool supported and axially displaceable within said primary spool bore; a secondary spool supported and axially displaceable within said secondary spool bore; a first cross-flow port and second cross flow port providing fluid communication between said primary spool bore and said secondary spool bore, at least one compression outlet port and at least one expansion outlet port both extending from said primary spool bore, and a venting outlet port.

2. An actuator controller according to claim 1, wherein the primary spool bore is formed with a first chamber and an second chamber partitioned from one another by a neck portion sealable by a first seal fixed over the primary spool; said primary spool further comprises a first one-way seal membrane extending in the first chamber and admitting flow in direction from the inlet port towards the first chamber, and a second one-way seal membrane extending in the second chamber, and admitting fluid flow only in direction from the first chamber towards the second chamber; and a second seal fitted at an end of the primary spool to selectively seal the venting outlet port.

3. An actuator controller according to claim 1, wherein the secondary spool comprises a small spool head being in flow communication with the pressurized fluid inlet port and comprising a small seal; and a large spool head comprising a large seal extending within a major chamber of a second spool bore and being in flow communication with the expansion outlet port.

4. An actuator controller according to claim 3, wherein the secondary spool is displaceable between a first position in which the small seal seals fluid flow between the pressurized fluid inlet and the first cross-flow port, and a second position admitting fluid flow between.

5. An actuator controller according to claim 3, wherein the secondary spool comprises a secondary first chamber being in fluid communication with the pressurized fluid inlet and partitioned from an intermediate chamber by the small seal; said intermediate chamber being in flow communication with the first cross-flow port; and a major chamber partitioned from the intermediate chamber by the large seal and being in flow communication with the second cross flow port.

6. An actuator controller according to claim 5, wherein the large spool area has a large surface area extending in the major chamber, and a small surface area extending in said intermediate chamber.

7. An actuator controller according to claim 2, wherein the second one-way seal membrane is axially displaceable about the primary spool.

8. An actuator controller according to claim 1, wherein the body is fitted with a manual override for axially displacing the primary spool within the primary spool bore so as to open the venting outlet port.

9. An actuator controller according to claim 1, wherein there is further provided an adjusting member for adjusting axial positioning of the primary spool so as to govern seal engagement of the first seal of the primary spool within the neck portion of the primary spool bore.

10. An actuator controller according to claim 1, wherein the at least one compression outlet port and at least one expansion outlet port are fitted with a Namur-type coupler.

11. An actuator controller according to claim 2, wherein the venting outlet port is fitted with an adjustable valve for controlling venting rate of the second chamber.

12. An actuator controller according to claim 1, wherein the first cross-flow port and second cross flow port extend coaxially with the compression outlet port and at least one expansion outlet port, respectively.

13. An actuator controller according to claim 2, wherein the primary spool is displaceable between a first extreme position where a fore spool head bears against a sealing plug of the primary spool bore, and a second extreme position wherein a shoulder of the primary spool extending intermediate the first seal and the first one-way valve seal bears against a shoulder of the neck portion of the primary spool bore.

14. An actuator controller according to claim 1, for use in conjunction with a return biased actuator.

15. An actuator controller according to claim 2, wherein pressurizing the pressurized fluid inlet port entails full displacement of the primary spool and the secondary spool into a second extreme position respectively, wherein the primary spool is displaced so as to admit pressurized fluid flow to the compression outlet port and the first chamber and an second chamber are sealingly disengaged from one another; and the secondary spool is displaced so as to seal fluid flow between the pressurized fluid inlet and the first cross-flow port.

16. An actuator controller according to claim 15, wherein terminating pressure through the pressurized fluid inlet port entails displacement of the primary spool to a first extreme position so as to seal the venting outlet port and resume fluid flow between the first chamber and the second chamber; and further, the secondary spool displaces so as to resume fluid flow in direction from the first cross-flow port towards the pressurized fluid inlet, responsive to pressure equilibrium at the first chamber and the second chamber.

17. An actuator controller according to claim 2, wherein the venting outlet port opens only to exhaust fluid from the second chamber and is otherwise sealed by a sealing ring mounted on the primary spool, to thereby prevent external fluid from entering the controller through the venting outlet port.

18. An actuator controller according to claim 1, wherein upon supply pressure fluctuations the controller maintains its position so as to retain its last acquired position with maximal stored compressed fluid.

19. An actuator system comprising an actuator and an actuator controller according to claim 1, said actuator being formed with one or more pistons displaceable within a piston cylinder, each cylinder being sealingly divided into a first chamber being in flow communication with an compression outlet port of the said actuator controller, and an second chamber being in flow communication with an compression outlet port of said actuator controller; said piston being biased in direction to expand said second chamber.

* * * * *